US006883336B2

(12) United States Patent
Dudley et al.

(10) Patent No.: US 6,883,336 B2
(45) Date of Patent: Apr. 26, 2005

(54) AIR CONDITIONING CONDENSATION DRAINAGE SYSTEM

(75) Inventors: William E. Dudley, Weimer, TX (US); C. Ross Dutton, Friendswood, TX (US)

(73) Assignees: Crossd Holdings, LTD, Friendswood, TX (US); BJBJ, LTD, Weirneir, TX (US)

( * ) Notice: Subject to any disclaimer, the term of this patent is extended or adjusted under 35 U.S.C. 154(b) by 0 days.

(21) Appl. No.: 10/341,920

(22) Filed: Jan. 13, 2003

(65) Prior Publication Data

US 2004/0134213 A1 Jul. 15, 2004

(51) Int. Cl.[7] ..... F25B 1/00
(52) U.S. Cl. ..... 62/115; 62/259.1; 62/285
(58) Field of Search ..... 62/115, 285, 288, 62/289, 291, DIG. 16, 259.1; 137/357; 52/11, 13, 15, 302.1

(56) References Cited

U.S. PATENT DOCUMENTS 4,118,083 A * 10/1978 Lackey et al. ..... 312/100
4,893,481 A * 1/1990 Sullivan ..... 62/291
5,664,430 A * 9/1997 Karman ..... 62/285
5,669,230 A * 9/1997 Bruce et al. ..... 62/285
5,694,785 A * 12/1997 Balentine ..... 62/275
5,765,329 A * 6/1998 Huang ..... 53/302.3
6,164,019 A * 12/2000 Salley ..... 52/11
6,167,717 B1 * 1/2001 Dudley et al. ..... 62/291

FOREIGN PATENT DOCUMENTS

EP 0505171 A2 * 9/1992
EP 1136633 A1 * 9/2001

* cited by examiner

*Primary Examiner*—William E. Tapolcai
*Assistant Examiner*—Mohammad M. Ali
(74) *Attorney, Agent, or Firm*—James L. Jackson

(57) ABSTRACT

An air-conditioning condensate drainage system for mounting to the roof membrane of the roof structure of buildings or for construction thereof directly onto the roof membrane of a building structure. The air-conditioning condensate drainage system is defined by one or more strips of material having an isolation membrane having a bottom surface for assembly to a roof membrane. A pair of spaced ridge elements project upwardly from the isolation membrane and cooperate with the isolation membrane to define an air-conditioning condensate drainage channel. In the alternative, ridge strips may be disposed in spaced relation and fixed directly to a roof membrane to define condensate drain channels along the roof membrane to in-roof drains. The condensate drain strip or ridge strips may be molded or extruded and maybe formed directly on and adhered to or fixed to the roof membrane to define the condensate drain channels.

14 Claims, 4 Drawing Sheets

FIG. 1
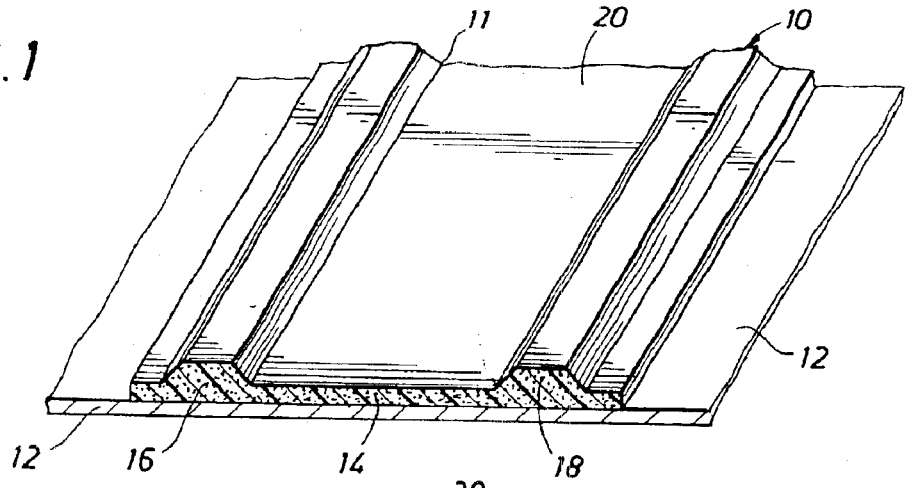
FIG. 2
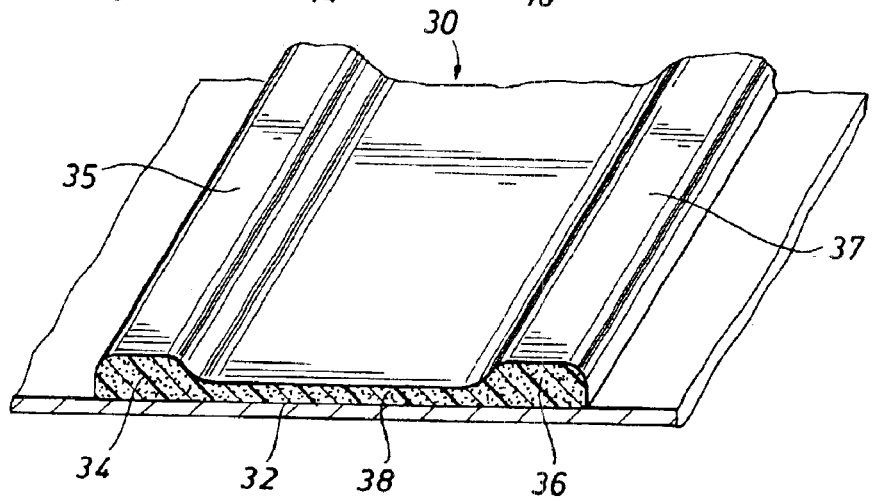
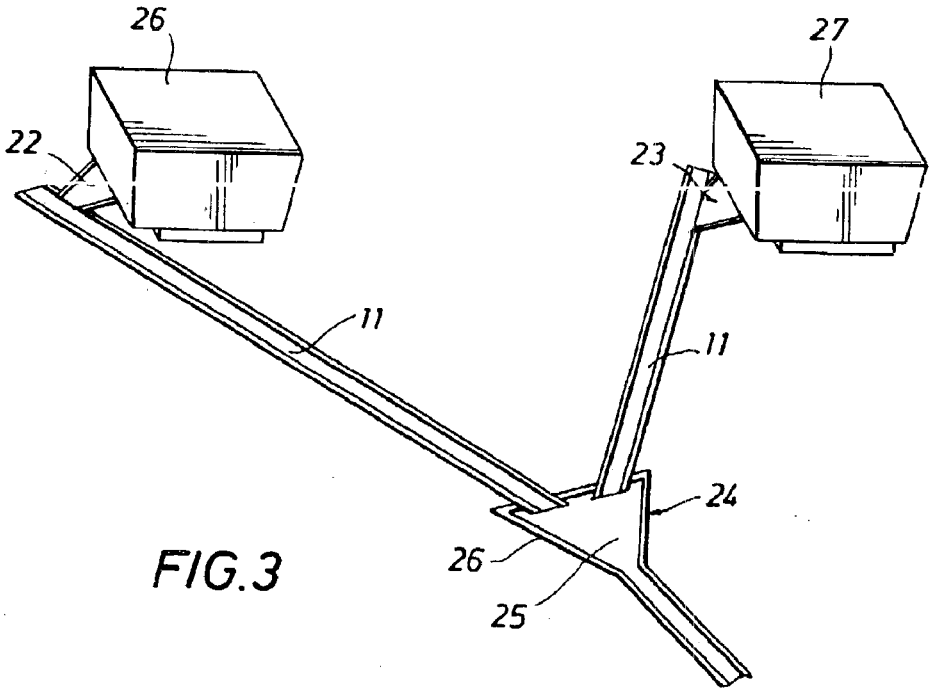
FIG. 3

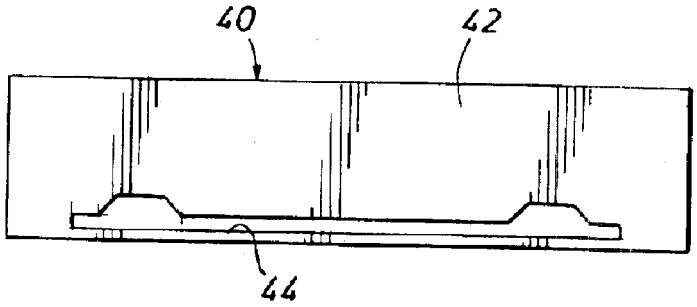
FIG. 4
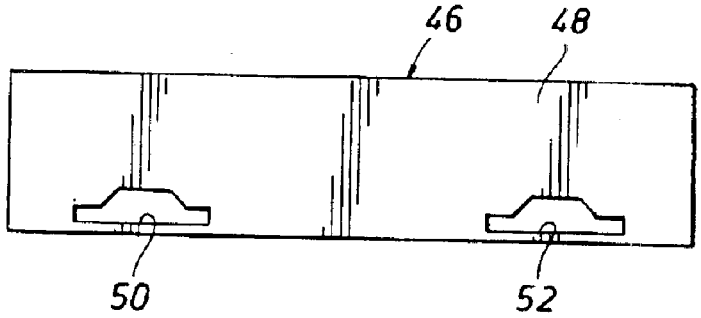
FIG. 5
FIG. 6
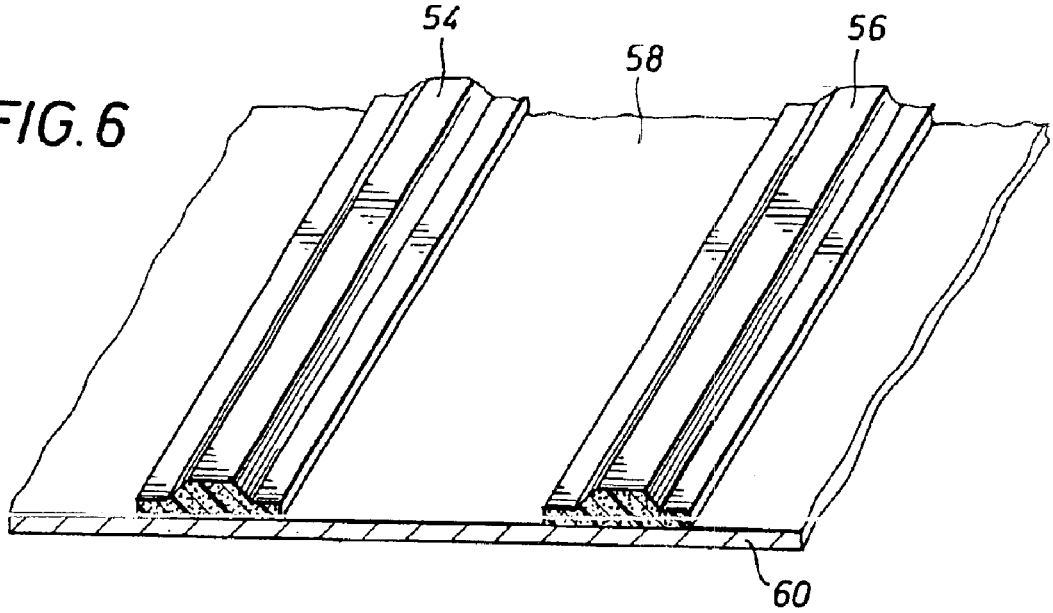
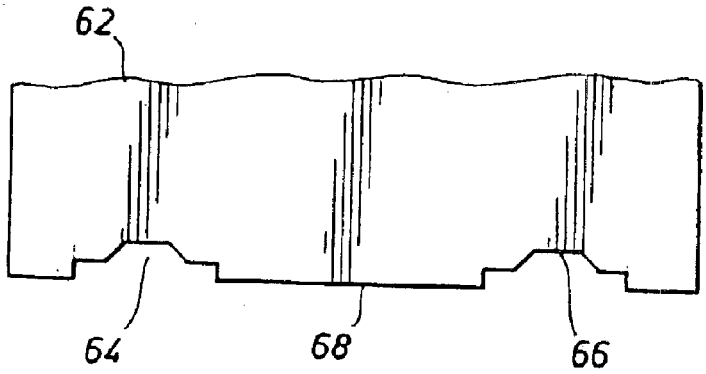
FIG. 7

FIG. 8
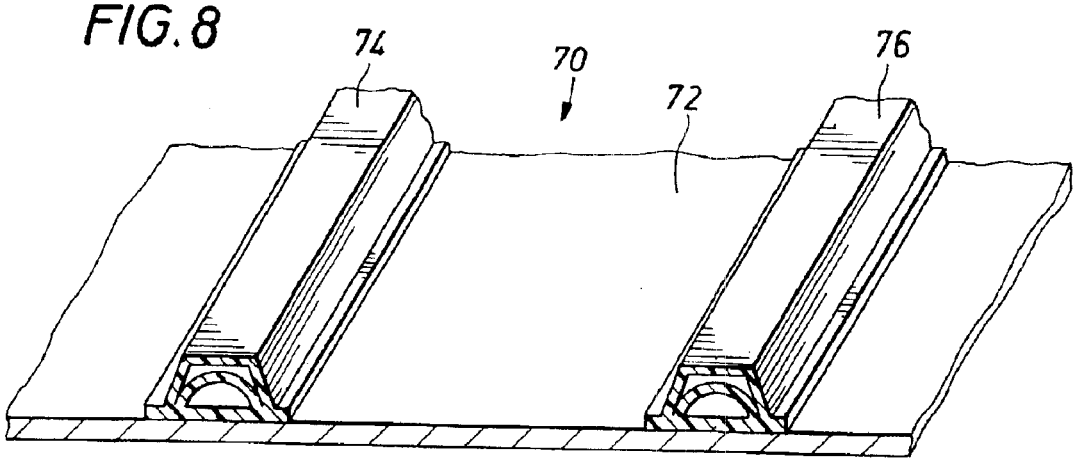
FIG. 9
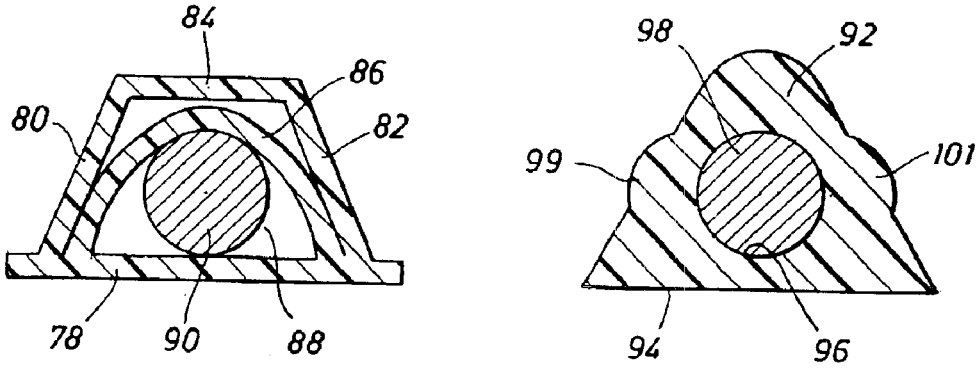
FIG. 10
FIG. 11
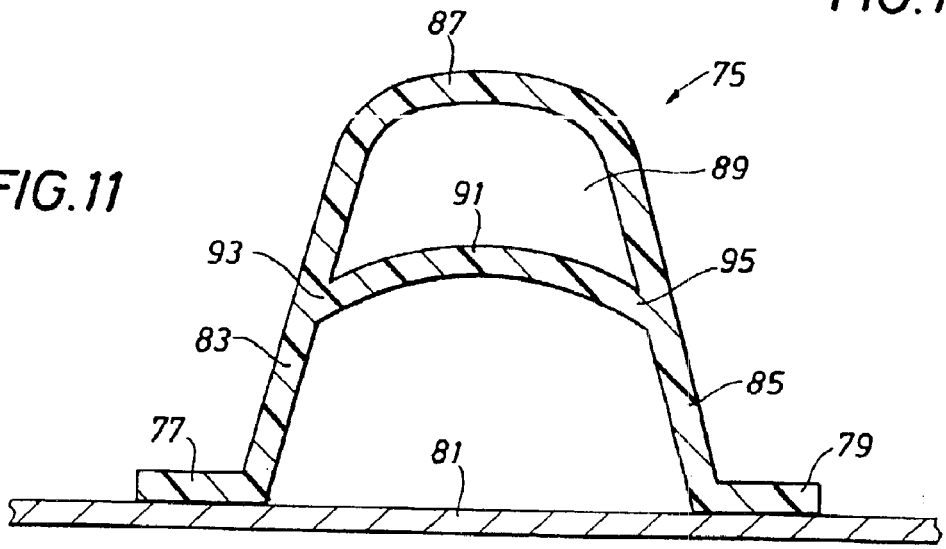

AIR CONDITIONING CONDENSATION DRAINAGE SYSTEM

CROSS-REFERENCED TO RELATED PATENT

The present invention concerns an improvement to the subject matter of U.S. Pat. No. 6,167,717 for "Air Conditioning Condensation Drainage System", which issued to William E. Dudley and C. Ross Dutton on Jan. 2, 2001.

BACKGROUND OF THE INVENTION

1. Field of the Invention

The present invention relates generally to the compromise or deterioration of roofing membrane materials by the condensate from air conditioning systems that are mounted on or above the roofs of commercial buildings that are finished with a roofing membrane that is slightly inclined or contoured, so as to direct water to drain openings in the roof and into drain conduits. More particularly, the present invention concerns the provision of a roof mounted drain system for collecting air conditioning condensate from roof-mounted air-conditioning units and conducting the condensate to a disposal drain and simultaneously isolating the roof membrane from contact by the air conditioning condensate. Even more specifically, the present invention concerns structure and materials for creating a plurality of nondestructive water conducting paths over the surface of a roofing system, that will direct discharged air conditioning condensate from roof mounted air conditioning units to one or more in-roof drains or gutters for disposal and will serve to isolate the roof membrane from the condensate.

2. Description of the Prior Art

Roofing membrane deterioration is typically caused by the presence of persistent air conditioning ("a/c") condensation in localized areas on a roof surface, regardless of the roof surface membrane or construction. It has been determined through tests that a/c condensation moisture is laden with various chemical constituents and heavy metal concentration. Moreover, as water evaporation occurs and a/c condensation continues to be added onto the roofing membrane, the concentration of chemicals and heavy metals will continuously increase thus increasing the detrimental effect of these materials to the roofing membrane. Particularly, a/c condensation fluids attack the roof membrane in areas where it flows and in collection areas where it tends to collect in pools on the roof membrane surface. It has been found that summer heat will actually turn the water flows and pools into boiling water which will literally oxidize the roofing membrane. Extreme cold will freeze these water flows and pools causing fissures in the roof membrane surface. This problem is well documented by the National Roofing Contractors Association, manufacturers of roofing materials, and other roofing industry experts. Present methods of removing the a/c condensation from the roof surface are not effective. The following is a brief description of the most commonly utilized methods for a/c condensation removal from roofing systems.

PVC or Metal Piping

The most common method utilized for the collecting and removal of a/c condensation from a roofing system is to connect a form of piping to the a/c unit and to run the piping from the unit to a suitable point of drainage. Typically, condensate collected in the condensate collection pan of a/c unit will exit the collection pan at a discharge opening and will flow into a drain line through a water trap, also referred to as a "P-trap". The P-trap is a U-shaped conduit section maintaining a water seal between the collection pan and the drain line which functions to isolate air within the drain line from the interior of the a/c unit. Debris and algae will build up or become deposited within the P-trap as well as the drain line and will block the flow of condensate discharge from the collection pan. When a/c condensate drainage piping is utilized, the different types of drainage piping will vary from polyvinyl chloride (PVC) piping, galvanized steel piping, copper piping, and even black iron gas line piping. It has been found with condensate drainage piping that the piping systems quickly become clogged with debris and algae that is present within the drainage system, especially when the a/c unit is situated in a humid environment. It is not unusual for P-traps and drain lines to require service three to four times per year to remove algae and debris blockage Obviously, when a/c drain conduits become clogged to the point that condensate water cannot flow freely therethrough, the condensate will build up within the condensate collection pan until it flows into air flow ductwork and then seeks its way into the building. Service personnel are then called on an emergency basis to repair the roof sufficiently prevent leakage of water into the building. At times condensate will build up within the a/c unit until it begins to leak around the edges of the collection pan, in which case it will flow onto the roofing membrane, causing deterioration of the roof membrane as mentioned herein. If the a/c unit structure is partially rusted away adjacent the perimeter of the condensate collection pan, which is often the case, significant leakage of condensate onto the roofing membrane will occur. The condensate will then flow along the roof membrane, following the natural slope of the roof membrane and will develop one or more pools of condensate liquid on the roof surface. This condensate liquid, because it is laden with chemicals and heavy metals as mention above, will begin to degrade the roof membrane. As typically occurs in roofing systems, having condensate drain conduits, because of traffic, age, and constant clogging problems requiring significant maintenance effort and expense, personnel having the responsibility for building maintenance will eventually disconnect the condensate drainage pipes from the air conditioning units. This of course, will cause the a/c condensate to be discharged directly from the collection pan through the drain opening and onto the roof membrane surface. When the drain piping is disconnected in this manner, it is done with the knowledge that deterioration of the roofing membrane by the discharged a/c condensate will eventually result and that, as a consequence, roofing repair will be necessitated in a relatively short period of time. The eventual result is that the disconnected a/c drainage pipes will end up as debris that is present on the roof surface. This disconnected piping debris obviously presents a hazard to workers engaged in roofing maintenance and repair and can be a cause of damage to the roofing membrane.

Internal Piping

While commercial buildings can be provided with internal a/c drain piping systems that extend throughout the building structure to conventional building drain lines, this internal piping method is seldom used because it is expensive and requires frequent maintenance. Internal condensate drainage piping is a piping system that is connected with the condensate discharge drains of the various a/c units and extends to plumbing drain lines within the confines of the building structure. Debris collected by the condensate of the a/c units will flow along with the condensate into the drain lines and in time will clog the lines. The algae that builds up in all a/c drain lines also causes clogging of the lines. In a relatively short time the drain lines will be sufficiently blocked that flow of condensate drainage will be blocked. This will cause the a/c condensate to enter duct-work and flow into the building structure as mentioned above. These systems are virtually always abandoned due to clogging because the drain lines, being located within the building structure are difficult to access and service or repair.

Surface Drainage

Even though the presence of a/c condensate on a roof membrane is known to cause damage to the roofing system, surface drainage is the method that is most often employed for condensate drainage. Since drainage systems composed of metal or PVC pipe will become clogged and inoperative in a short period of time and are also expensive to install and maintain, it has been found most practical to allow roof surface drainage to occur, knowing that the roofing system will require repair at more frequent intervals. In this case, persistent a/c condensation fluids are allowed to collect in certain areas on the roof membrane surface, causing extensive and accelerated roof membrane deterioration. It is desirable therefore to provide an a/c condensate drainage system for flat roofed building structures which will not be subject to frequent blockage by debris, algae and the like and yet will continuously exclude a/c condensate drainage fluid from the roof membrane surface. It is also desirable to provide flat roofing systems of building structures with a/c condensate drain systems that will efficiently drain a/c condensate fluid along the roof surface to appropriate roof drains for disposal without permitting the a/c condensate to collect on the roof membrane.

Types of Roofing Systems

The following types of roofing systems with roof mounted a/c units are specifically noted as roofing systems that would benefit from installation of an air conditioning condensation drainage system according to the present invention.

Single Ply Roofing Systems

This type of roofing system includes all single ply systems such as ethylene propylene diene monomer or ethylene propylene diene terpolymer (EPDM), polyvinyl chloride (PVC), chlorosulfonated polyethylene (CSPE), also referred to by its registered trademark HYPALON®, thermoplastic olefin (TPO), and/or other types of single ply roofing membranes of chemically or heat welded seam systems.

Modified Bitumen Roofing Systems

Modified bitumen roofing systems include all types of roofing systems that have a styrene butadiene styrene (SBS) or atactic polypropylene (APP) modified bitumen surface layer.

Built-Up Roofing Systems

Built-up roofing (BUR) systems include all types of coal tar and asphalt built-up roofing systems that utilize felts or other fabrics as interply sheets that represent integral components of construction.

Metal Roofing Systems

The term "metal roofing systems" is intended to encompass standing seam metal roofing, corrugated metal roofing and any other metal roofing that is applied in panels and having leakage preventing treatment at any panel joints that exist. The term "metal roofing systems" is also intended to encompass metal roofing installations having a metal roofing membrane and having ridge members which are attached to metal roofing by means of cement, bonding material or the like and which simulate standing seam metal roofing.

Other Roofing Systems

The term "other roofing systems" is intended to encompass all other types of roofing systems that have a smooth surface of material or materials being exposed to weather and which define a roofing membrane that excludes water from the interior of a building structure.

SUMMARY OF THE INVENTION

It is a principal feature of the present invention to provide a novel a/c condensate drainage system for the roofing systems of buildings which provides for a/c condensate drainage along the contour of the surface of the roofing membrane and yet isolates most of the roofing membrane from continuous exposure to the condensate fluid and the chemical and heavy metal constituents contained therein;

It is another feature of the present invention to provide a novel a/c condensate drainage system for the roofing systems of buildings which can be provided in the form of one or more strip structures that are intended to be installed directly on the roof membrane surface of a roofing system to provide an open roof mounted surface drainage channel or closed drainage channel to conduct a/c condensate directly from an a/c unit to a roof mounted water drain of the roof structure;

It is an even further feature of the present invention to provide a novel a/c condensate drainage system for the roofing systems of buildings wherein the drainage system can be constructed of similar or identical roof membrane materials as compared to the roof membrane or can be of integral molded construction so that the surface mounted a/c condensate drainage system will be of sacrificial nature, being replaced as needed to permit the basic underlying roofing membrane to have a normal or conventional service life;

It is an even feature of the present invention to provide a novel a/c condensate drainage system for the roofing systems of buildings which is designed to capture air conditioning condensate and to channel the condensate along a non-destructive path over the surface of a roofing system and will direct the discharge condensation from roof mounted a/c units into an in-roof drain or gutter that is constructed from any of a number of existing roofing materials such as bitumen, rubber, CSPE, PVC, foam, TPO, asphaltic, HYPALON®, and/or any other common or uncommon materials used in the roofing industry; and It is another feature of the present invention to provide a novel a/c condensate drainage system for the roofing systems of buildings which includes the use of pre-manufactured surface drainage system materials that are designed for installation onto a roof membrane to create a non destructive path over the surface of a roofing system and will direct the discharge condensation from roof mounted a/c units to an in-roof drain or gutter;

It is another feature of the present invention to provide a novel a/c condensate drainage system having a drain channel structure that is in the form of one or more strips of material which can be cemented, bonded or heat sealed to a conventional roofing membrane and can be molded and adhered to the roofing membrane or molded onto the roofing membrane to define one or more drainage channels for conducting air-conditioning condensate along a roof surface to one or more drains of the roof;

It is also a feature of the present invention to provide a novel a/c condensate drainage system for the roofing systems of buildings which is of integral construction, being formed in any desired manner, such as by molding or extrusion, including molding or extrusion of materials onto a roofing membrane to define air-conditioning condensate drainage channels or collector basins. The materials may be cured in place on the roofing membrane or bonded or cemented to the primary roofing membrane of a roof to create one or more water drain channels for draining a/c condensate or water from any other source to drain openings or gutters, while protecting the primary roofing membrane from accelerated deterioration by the substantially continuous presence of water, including air-conditioning condensate or its constituents.

It is another important feature of the present invention to provide a novel method and apparatus for installation of air-conditioning condensate drainage systems onto roof membrane surfaces, which include attachment of drainage channel forming materials to roof surfaces, molding of drainage channel structures directly onto roof surfaces and extrusion of drainage channel configurations from dies directly onto roof surfaces.

Briefly, the various objects and features of the present invention are realized through the provision of an a/c condensate drainage system having one or more strips of material that are secured in any desirable manner to a roof membrane surface for the purpose of defining a drainage channel along the roof surface for air-conditioning condensate emanating from roof mounted air-conditioning units, an isolation wall or membrane which is applied to a roof membrane surface by heat welding, bonding or by any other suitable means that is common to the roofing industry. This isolation wall or membrane can be a component of an integral or one-piece construction for an air-conditioning condensate drain element will be exposed to the weather and any a/c condensate that is present and will form the bottom surface of a roof mounted drain channel structure for conducting a/c condensate along the roof surface to an appropriate in-roof drain. One of the principal functions of this isolation membrane is to ensure that the a/c condensate does not come into contact with the roofing membrane over which it flows. A pair of lateral ridge structures project upwardly from the outer edge portions of the isolation membrane and are disposed in spaced relation so as to define a condensate channel there between. The lateral ridge structures can be integral with the isolation membrane, such as when integrally formed by a molding or extrusion process, and define spacing containment walls which are of sufficient height to efficiently drain a/c condensate along the drain channel without allowing it to overflow from the condensate drainage channel and spill onto the roof membrane surface. The lateral ridge structures may be composed of multiple layers of any suitable roofing material if desired. Alternatively, the lateral ridge structures may be formed by certain roofing materials such as asphaltic impregnated board, for example, which is fixed to the isolation membrane and which is then overlaid by one or more layers of roofing membrane material so that the condensate drain channel is defined largely by the upper layer of overlying roofing membrane material and the drain channel defined thereby. The a/c drain element, if desired, maybe formed onto the roofing membrane surface by an extrusion process which causes the a/c drain element to firmly adhere or become cemented or bonded to the roof membrane.

Under circumstances where an isolation membrane of a roofing installation is composed of a material that effectively resists deterioration by the chemical constituents of air-conditioning condensate, air-conditioning condensate drainage channels may be defined on the isolation membrane by adhering strips of ridge material in spaced relation onto the isolation membrane. Preferably these ridge strips will be of generally triangular configuration, having a reasonably large base surface for cementing or bonding to the isolation membrane and with inclined lateral surfaces converging in cross-section to a relatively narrow apex. The ends of the ridge strips, and perhaps the entire ridge strips will define central openings receiving joint alignment dowels that align abutting ends of the ridge strip material. Suitable adhesive or bonding material will typically secure the ends of the ridge strips in aligned abutting assembly. If desired, strips of air-conditioning condensate drainage channel material, having a central membrane and spaced channel forming ridges may have joint configurations that interfit and overlap to ensure against leakage, and the ridges may have end openings defining receptacles for ridge alignment dowels.

As a further alternative, an a/c drain channel may be formed on a roof membrane or on a drain channel membrane layer covering a roof membrane. In this case, strips of ridge defining material can be heat sealed, cemented, bonded or otherwise secured to the roof membrane or drain channel membrane layer and can be spaced as desired for defining a drain channel of desired width. Strips of ridge defining material of this nature can be applied to the roof membrane or a drain channel membrane in a manner defining one or more collector junctions or receptacles that are arranged to receive a/c condensate from two or more a/c drain channels to minimize the amount of drain channel material that might be required to effectively prepare a roofing system for a/c condensate drainage.

A polymer foam material may be extruded from an extrusion machine directly onto a roofing membrane and may be formed to a desired air-conditioning condensate drainage channel configuration such as by means of an extrusion die of the machine. Alternatively, the polymer form material emerging from an extrusion machine onto a roofing membrane surface can be rolled or otherwise formed in its uncured state, so as to cure to the desired configuration to define a drainage channel. After curing, an external lining of a suitable protective material may be sprayed onto or painted onto the polymer form to thus define a durable and impervious external lining for a drainage channel structure.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings

FIG. 1 is an isometric illustration of a part of an integrally constructed product strip representing an a/c condensate drainage system which is constructed in accordance with the principles of the present invention and is shown affixed to the roofing membrane of building structure;

FIG. 2 is an isometric illustration of a part of an integrally constructed product strip representing an a/c condensate drainage system which is constructed in accordance with the principles of the present invention and which is molded or extruded onto a roof membrane surface or attached thereto in any suitable manner;

Figure 12:
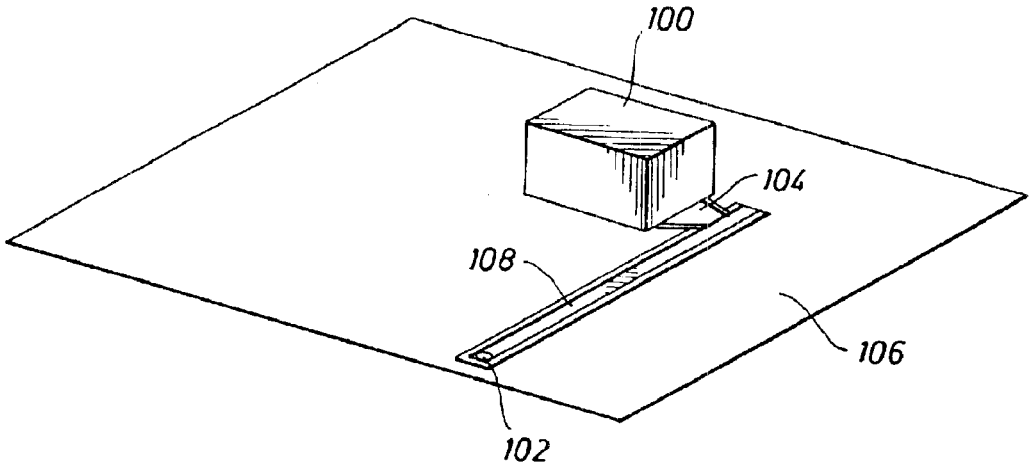
Figure 13:
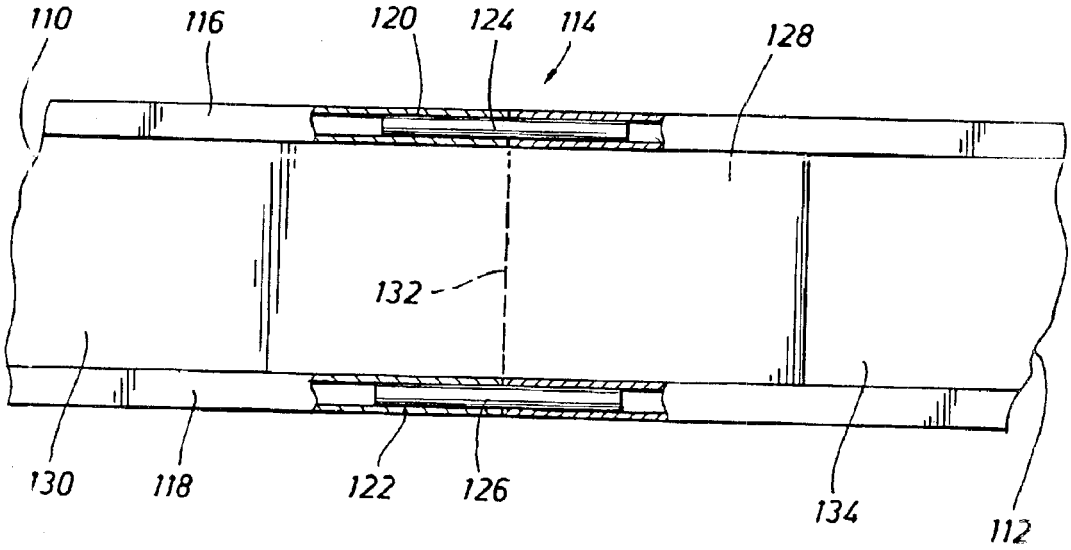

FIG. 3 is an isometric illustration of a part of a roofing system and showing two roof mounted air-conditioning units and an air conditioning condensate drainage system which is constructed in accordance with the principles of the present invention and incorporates condensate collector basins having condensate drainage channels leading from the air-conditioning units to a channel drainage collector disposed in feeding relation with another drainage channel;

FIG. 4 is an elevational view of a plate-type extrusion die for extruding an air-conditioning condensate drainage strip having the configuration shown in FIG. 1;

FIG. 5 is an elevational view of a plate-type extrusion die for extruding a pair of spaced air-conditioning condensate drainage strips having the configuration shown in FIG. 6 and which may be extruded for later attachment to a roof membrane or which may be directly extruded onto a roofing membrane;

FIG. 6 is an isometric illustration showing a pair of condensate drainage control strips that may be extruded from the die of FIG. 5 or might be formed in any other suitable fashion for attachment to a roofing membrane or extruded directly on a roofing membrane;

FIG. 7 is an elevational illustration of a striker plate having a configuration for striking off excess extruded or laid foam material to define the spaced ridge element of an air-conditioning condensate drainage channel;

FIG. 8 is an isometric illustration of a part of a roof membrane, having affixed thereto two spaced strips of a/c condensate drainage ridge material which is constructed in accordance with the principles of the present invention;

FIG. 9 is a sectional view of a ridge strip construction for an air-conditioning condensate drainage channel or catch basin and having an internal structural wall and showing a joint alignment dowel member located within an opening defined in part by the internal structural wall;

FIG. 10 is a sectional view of a ridge strip construction for an air-conditioning condensate drainage channel or catch basin and having an internal passage or opening having a joint alignment dowel member located therein for strip alignment at joints;

FIG. 11 is a sectional view of a ridge strip element being similar to that of FIG. 9 and being adapted for condensate drainage channel or catch basin construction on roofing installations;

FIG. 12 is an isometric illustration showing a roof structure having an air-conditioning unit mounted thereon and showing a air-conditioning condensate drainage channel being defined by spaced ridge elements applied directly to the roof membrane or to a roof mounted panel defining a portion of a drain channel; and FIG. 13 is a plan view of joined strips of air-conditioning condensate drainage channel material, with parts thereof broken away and shown in section and illustrating dowelled interconnection and overlapping panel sections for joint integrity and joint leakage prevention.

DETAILED DESCRIPTION OF PREFERRED EMBODIMENT

Referring now to the drawings and first to FIG. 1, an air-conditioning condensate drainage system constructed in accordance with the principles of the present invention and representing the preferred embodiment is shown generally at 10 and is shown in the figure as a partial strip of condensate drain structure which is shown to be mounted in any suitable fashion onto the roofing membrane 12 of a building roofing system. The air-conditioning condensate drainage system 10 comprises an isolation membrane 14 which is typically in the form of an elongate strip of material that is compatible with the membrane material of the roofing membrane 12. Preferably, the isolation membrane will be a component of an integral construction composed of a polymer material such as polyvinyl chloride (PVC) which may be layered with other suitable materials and may be reinforced by a suitable fabric to enhance the structural integrity thereof. The integral condensate drainage strip material 11 may be manufactured by an extrusion process either being a pre-manufactured strip component for attachment to a roofing membrane surface or, in the alternative, may be composed of a syntactic foam material which is extruded or molded directly onto the roofing membrane. The isolation membrane 14 may be constructed of identical or similar material as compared with the roofing membrane and will be affixed to the upper surface of the roofing membrane 12 by heat welding, bonding, by suitable roofing adhesive or by any other installation method or materials as is common to the roofing industry. The isolation membrane typically serves as the bottom membrane layer or one of the bottom layers of the a/c condensate drainage strip or strips and functions to isolate the roofing membrane 12 from contact by a/c condensate and the chemicals and heavy metals present therein and also functions to define the bottom wall structure of a drainage channel for conducting a/c condensate from the condensate discharge of an a/c unit to a suitable drain in the roofing structure. From the isolation membrane projects at least a pair of spaced ridge defining elements 16 and 18 which are preferably integral with the isolation membrane or web 14. Additionally, the strip material 11 and its spaced ridge defining elements 16 and 18 may be composed of a heat weldable polymer material such as PVC which is heat welded to the roof membrane 12 and thus is a permanent integral component of the air-conditioning condensate drainage system. The spaced ridge defining elements are typically oriented in substantially parallel relation so as to define a condensate drain channel 20 therebetween. It should be borne in mind however, that the spaced ridge elements 16 and 18 may be oriented in angular relation to one another or oriented in any other suitable relation to define a drainage channel of desired configuration and dimension. For example, as is evident from FIG. 3 hereof, the spaced ridge defining elements and the resulting ridges defined thereby can be oriented in diverging relation so as to define a catch basin 22 or 23 for collecting condensate being discharged by the condensate drain openings 24 of one or more a/c units, such as is shown at 26 and 27. Typically, a catch basin 22 or 23 will be provided in the form of a pre-manufactured connector structure 23 which is affixed to the roofing membrane and is also affixed in suitable manner to a strip 11 of pre-manufactured condensate drain assembly. Alternatively, a catch basin structure 22 or 23 can be constructed in place on the roofing membrane so that its configuration can be suited to the a/c drain and the roof structure of the building. For conservation of materials, as shown in FIG. 3, condensate drain channels leading from air-conditioning units may conduct condensate to a collector basin structure shown generally at 24 which is preferably of generally triangular configuration, being defined by a collector membrane 25 having edge ridges 26. The installed or pre-manufactured collector basin structure 24 may be of any suitable configuration and may be used for connection of drain channels, for defining catch basins, for connecting drain channels with roof mounted drain fittings, etc, without departing from the spirit and scope of the present invention. It should also be borne in mind that the spaced ridge defining elements 16 and 18 of the condensate drainage strips or the ridges 26 of the collector basins may be of any suitable dimension or configuration that may be considered appropriate for defining spaced ridges having a drain channel or basin therebetween. The spaced ridge defining elements may be of substantially triangular or rhomboid cross-sectional configuration as shown in FIG. 1, of oval or curved cross-sectional configuration as shown in FIG. 2 if desired. In fact, the ridge defining elements may be of any configuration or dimension for defining spaced ridges projecting a suitable height above the isolation membrane or roof membrane surface to ensure that the maximum expected volume of a/c condensate and rain water or snow melt flow will be accommodated by the cross-sectional dimension and volumetric capacity of the drain channel. Additionally, since the roofing membranes of most commercial buildings are typically slightly sloped to enable surface drainage of the water resulting from rain, melting snow or ice to the in-roof surface drains of the roofing system, the spaced ridges of the condensate drain structure must be of sufficient height to compensate for the slight slope of the roofing membrane and yet provide for adequate containment of the a/c condensate that is intended to be acquired and controlled as it is conducted to a suitable in-roof drain for ultimate disposal. As an example, it should be noted that the ridge defining elements 16 and 18 may be of differing height if desired so that one drain channel ridge will have greater height than the other. This will allow the air-conditioning condensate drainage system to be mounted to a slightly sloping roof membrane in a manner accommodating its slope, and yet ensuring that the a/c condensate is adequately contained and is not permitted to spill over a ridge and onto the roofing membrane surface.

The embodiment shown generally at 30 in FIG. 2 may be of molded or extruded construction and defines a substantially planar bottom surface 32 for contact with a roofing membrane surface. A pair of spaced contoured side ridges 34 and 36 are preferably formed integrally with the isolation membrane 38 thereof and define ridges having a curved or contoured upper surface as shown at 35 and 37. The integral strip material of the embodiment 30 of FIG. 2 may be formed by an extrusion or molding process for later attachment as a pre-manufactured strip to the roofing membrane of a roofing installation. In the alternative, if desired, the integral strip of material of the embodiment may be extruded directly onto the roofing membrane, with the material thereof being bonded or adhered to the roofing membrane surface.

Referring now to FIGS. 4 and 5 of the drawings, extrusion dies are shown for extruding one of more strips of material either to form a pre-manufactured strip material for placement on the roof membrane of a roofing system or to extrude the strip material directly on the roof membrane surface. In the case of FIG. 4, an extrusion die shown generally at 40 is in the form of a die plate 42 having a single die opening 44 of the configuration for forming the condensate channel strip material of FIG. 1. In the case of FIG. 5, an extrusion die is shown generally at 46 which is in the form of a plate-like die 48 having a pair of extrusion openings 50 and 52 through which ridge strips, such as are shown at 54 and 56 in FIG. 6 may be extruded. The extrusion openings 50 and 52 are spaced properly to define a condensate drain channel 58 of desired volumetric capacity therebetween. As shown in FIG. 6, the ridge strips 54 and 56 may be heat sealed, cemented or bonded to a conventional roof membrane 60 or may be extruded directly onto the roof membrane such as by a channel forming extrusion machine that is moved along the roof membrane during installation of the ridge strips. If desired, the extruded ridge strips may be coated with a protective material that resists damage by ultraviolet rays. Also, if desired, the channel ridge strips may be formed from a plurality of materials or a plurality of layers of material, such as conventional roofing materials, and adhered to the roof membrane by heat sealing, cementing, bonding or by any other suitable means of attachment.

The strip material forming the air-conditioning condensate drain strip or strips can be supplied in rolls so that rolls of extended length can be shipped to end users. In the alternative, the air-conditioning condensate drainage strip material can be cut into strips of suitable length, i.e., ten foot lengths, twenty foot lengths, etc. and can then be packaged for shipment to wholesalers, retailers or end users.

It should also be born in mind that the drain structure shown in FIGS. 1–6 may also be installed by constructing them directly on the roof structure through the use of any suitable construction procedure and materials that are appropriate to the roofing industry.

As shown in FIG. 7, extruded or laid foam material in its uncured state may be formed to desired configuration by a striker plate 62 having openings 64 and 66 that form the uncured foam material to define spaced ridges, with edge 68 defining a flat surface configuration during striking of the foam material. After the material has been formed and cured a coating of UV protective material may be applied to the cured foam substrate in any desirable manner.

As a further example, the air-conditioning condensate drainage system of FIGS. 1–3 can be installed in place on the roof membrane of a roofing system according to the following procedure: The isolation membrane 12 can be installed directly onto the roof membrane and suitably oriented to accommodate the slope of the roof membrane. The ridge defining structures of the strip material may then be placed in suitably spaced relation on the isolation membrane or directly on the roof membrane, so that the roof membrane becomes a portion of the condensate drain channel structure. The height of the ridge defining structures should be sufficient to accommodate unusually low areas of the roofing installation that occur due to roofing tolerances.

FIGS. 1, 2 and 6 illustrate a/c condensate drainage strip materials of monolithic or integral construction and which may be formed by extrusion, molding or fabrication. These strip profiles maybe composed of polymer foam material PVC, Modified bitumens, Hypalons, CSPE, EPDM, and/or other suitable materials that are suitable for condensate drainage channels on roofing systems. In each case the profiles define spaced ridges and a bottom wall to confine a/c condensate and typically prevent its contact with the roof membrane to which the a/c condensate drainage system is affixed. If desired, however, ridge strips may be applied in any suitable manner to a roof membrane surface so as to use the membrane surface between the strips to form portions of the drain channels. The strip materials may be composed of any of a number of commercially available expandable foam materials which may be formed in place or may be pre-manufactured and then affixed to a roofing membrane by cementing, bonding or by any other suitable means. The condensate drainage strip material may be composed of any of a number of suitable materials having the capability for resisting damage in the presence of the heavy metal and chemical constituents of air-conditioning condensate.

The isometric illustration of FIG. 8 shows an air-conditioning condensate drainage installation shown generally at 70, having a central membrane 72 that may be the uppermost membrane of a roofing installation or may be an isolation membrane of the general nature shown at 14 in FIG. 1. Pre-manufactured ridge strips 74 and 76 are installed onto the membrane 72 in any suitable manner. The ridge strips 74 and 76 are each of the general configuration that is shown in FIG. 9 and having a wide base wall 78 for attachment to the membrane and tapered side walls 80 and 82 extending in upwardly converging relation from the base wall. A generally flat top wall 84 is integral with the side walls. Within the hollow interior of the ridge strip is located a structural wall 86 that is shown to be of curved configuration and defines structural wall edges 87 and 89 that are either joined with the base wall 78 or with the side walls 80 and 82 or both. The structural wall 86 provides the hollow ridge strip with enhanced structural integrity and prevents its collapse. It should be borne in mind that the internal structural wall 86 may have a configuration other than the curved configuration that is shown. The curvature of the structural wall 86 and its relation with the base wall 78 defines an internal passage region 88 that permits the location of a dowel 90 within the internal passage. A dowel would be used at abutting joints of the ridge strip material to align the abutting strip ends, to facilitate connection of the ends of abutting strips and to provide the strip ends and the resulting joint with enhanced structural integrity. The dowel will extend into the passages of abutting ridge strips and permit the abutting ends of the ridge strips to be joined by cement or bonding material or to be heat welded or otherwise secured.

Another ridge strip embodiment is shown in FIG. 10 and comprises a strip body 92 of generally triangular configuration, which defines a rather wide or broad base surface 94 that is adapted for being cemented, bonded or heat welded to a roof membrane or a drainage channel membrane. The ridge strip 92 defines inclined, upwardly converging side surfaces 93 and 95 which merge with a ridge top surface 97 which can be of arcuate cross-sectional configuration as shown or may be of substantially planar configuration, essentially as shown in FIG. 9. The ridge strip may be composed of any suitable polymer material or any of a number of acceptable roofing materials, such as indicated above. The ridge strip 92 defines a central passage 96 which receives a dowel member 98 in the same general manner as described in connection with FIG. 9. The dowel bridges the joint of abutting ridge strips, maintains alignment of the abutting ends of the ridge strips and enhances the capability of the ridge strips to be attached to one another to form a secure joint. The strip body structure may also be designed with opposed lateral rib elements 99 and 101 which provide a strengthening function for the strip as well as establishing an aesthetic appearance of the strip, when it is installed on a roofing membrane or on an isolation membrane to define a condensate drain channel.

In some cases the tolerances of roofing installations cause the slope of the roofing membrane to be uneven so that a roof surface condition exists that causes water "pooling" on the roofing membrane. When these pooling areas of a roof are traversed by the condensate drainage strips or panels of the present invention, water pooling within a drainage channel can occur. It is appropriate in such case, therefore, to provide condensate drainage channel installations having drainage channel ridges of greater height so that pooling condensate will not overflow the drainage channels and spill onto the roofing membrane of the roofing installation. As shown in FIG. 11, a ridge strip shown generally at 75 is of extruded construction, having base flanges 77 and 79 to enable the ridge strip to be affixed to any suitable surface. As shown, the base flanges 77 and 79 may be cemented, heat welded or bonded to a substrate 81, which may be the bottom panel of a drainage channel strip or a section of a roofing membrane. Angulated side walls 83 and 85 are integral with the base flanges and extend upwardly therefrom and are disposed in upwardly converging relation with one another. The angulated side walls 83 and 85 merge smoothly with a curved upper wall structure 87 having an upwardly facing convex surface. The base flanges, angulated side walls and the curved upper wall structure cooperatively define an internal space 89. An intermediate structural wall 91 is located intermediate the internal space 89 and is arranged with its opposite side edges 93 and 95 integrally connected intermediate the upper and lower edges of the respective angulated sidewalls. The intermediate structural wall 91 is of curved configuration and is oriented with its convex surface facing upwardly. This curved configuration of the intermediate structural wall 91 provides the ridge strip with considerable structural integrity and permits it to be of substantial height, to contain condensate as well as rainwater, snow melt, etc. on roofing areas that are subject to pooling. For example, the height of the curved upper wall 87 above the substrate 81 can be in the order of one inch or greater, if desired, and yet the ridge strip will have excellent characteristics of structural integrity. The ridge strip construction may be composed of any of a number of polymer materials, conventional roofing materials as desired, without departing from the spirit and scope of the present invention.

As shown in FIG. 12, the ridge strip material of FIGS. 8–10 can be used to define air-conditioning condensate drainage channels extending from a roof mounted air-conditioning unit 100 to a roof drain opening 102. The ridge strip material can be arranged to define a catch basin 104 which receives all leaked condensate from the air-conditioning unit. The ridge strip material can be attached to the roof membrane 106 so as to define a drain channel 108, with the spaced ridges confining the condensate to the drain channel and ensuring that no lateral leakage occurs as the condensate is conducted to the drain opening of the roof.

As shown in FIG. 13, pre-manufactured condensate drain channel strips shown at 110 and 112 can be constructed so as to establish an interfitting joint shown generally at 114. In this case, the pre-manufactured drain channel strips each have side ridge elements 116 and 118 that are of tubular configuration or define dowel receptacles 120 and 122 at the ends, receiving dowel members 124 and 126. The dowel members achieve alignment of the ends of the ridge members, enhance the structural integrity of the ridge members at the joint and simplify the attachment of the abutting ridge members. A portion 128 of the central panel 130 of the strip material 110 extends beyond the ends of the ridge members and overlaps the end 132 of the opposite air-conditioning condensate drainage strip 112. The panel portion 128 is fixed to the central panel 134 of the strip material 112, such as by cementing, bonding, heat sealing or the like and prevents leakage of the central panels at the joint 114.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. An air-conditioning condensate drainage system for the roof structure of buildings, comprising:

at least two elongate strips of material extending from at least two roof mounted air-conditioning units along the roof structure and having an isolation membrane defining a bottom surface for assembly to a roof membrane and having an upper surface and having side edges;

a pair of ridges being located along said side edges of said elongate strip of material and each having a generally triangular cross-sectional configuration, said pair of ridges being disposed in spaced relation with one another and cooperating with said isolation membrane to define an air-conditioning condensate drainage channel between said ridges conducting air-conditioning condensate from the air-conditioning units;

at least one collector membrane of generally triangular configuration having side edges and defining a condensate collection basin;

edge ridges projecting upwardly from said side edges of said collector membrane and defining at least one inlet opening within which an end portion of at least one of said two elongate strips of material is located, said edge strips further defining an outlet opening of said condensate collection basin.

2. An air-conditioning condensate drainage system for air-conditioning units mounted on the roof structure of buildings, the roof structure having a roof membrane, comprising:

elongate strips of material extending from said air-conditioning units and having an isolation membrane defining a bottom surface for assembly to a roof membrane and having an upper surface, said elongate strips of material defining substantially parallel side edges;

a pair of ridges being integral with said substantially parallel side edges of said elongate strip of material and being disposed in spaced relation with one another and cooperating with said isolation membrane to define an air-conditioning condensate drainage channel between said ridges;

a panel member of generally triangular configuration being fixed to the roof membrane and having side edges;

ridges projecting upwardly from said side edges of said generally triangular panel member and being disposed in angular relation with one another and defining a condensate collection basin therebetween, said ridges defining at least one inlet opening within which a portion of said elongate strip of material is located and defining at least one outlet opening; and at least one condensate drain channel being in condensate draining communication with said condensate collection basin.

3. A method for installing an air-conditioning condensate drainage system on the roof structure of a building having one or more air-conditioning units, wherein the roof structure includes a roof membrane, said method comprising:

affixing a condensate collection basin to said roof membrane, said condensate collection basin having an isolation membrane of generally triangular configuration and perimeter ridges of sufficient height to define a collection basin of sufficient volume to accommodate the condensate drainage from a plurality of air-conditioning units, said condensate collection basin defining at least one inlet in communication with the condensate drain channel structure and having an outiet;

affixing at least one elongate strip of condensate drain material to the roof membrane along a desired drainage path from a plurality of air-conditioning units to said condensate collection basin, said condensate drain material defining a pair of spaced ridges defining a drainage path therebetween and being disposed in condensate supplying communication with said condensate collection basin; and affixing an elongate strip of condensate drain material to the roof membrane along a desired drainage path from said condensate collection basin to an in-roof drain of the roof structure, said elongate strip of condensate drain material having side edges and edge ridges projecting upwardly from said side edges.

4. The method of claim 3, comprising:

said affixing said elongate strip of condensate drain material and said condensate collection basin to the roof membrane of the roof structure being heat welding.

5. The method of claim 4, comprising:

said affixing said elongate strip of condensate drain material and said condensate collection basin to the roof membrane including application of mechanical pressure to said elongate strip of condensate drain material and said condensate collection basin during heat welding thereof.

6. An air-conditioning condensate drain channel structure, comprising:

at least one strip of substantially solid material having a mounting base sutface having a generally triangular cross-sectional configuration, having opposed angulated side surfaces extending upwardly from said base surface and being disposed in upwardly converging relation and merging with a ridge top surface;

at least one elongate ridge member projecting upwardly from said mounting base surface and having upwardly converging side surfaces and an upper surface intersecting said side surfaces;

said at least one strip of material being of hollow construction defining an interior space and having a base wall and angulated side walls projecting upwardly from said base wall and being disposed in upwardly converging relation with one another, said at least one strip of material having a strip top wall being integral with each of said side walls; and an intermediate structural wall being located within said interior space and having spaced bottom edges being in integral connection with at least said base wall, said intermediate structural wall providing said at least one strip of material with enhanced structural integrity.

7. The air-conditioning condensate drain channel structure of claim 6, comprising:

a dowel receptacle being defined between said intermediate structural wall and said base wall for receiving a dowel at a joint between abutting ridge strips for alignment of ridge strip ends for facilitating connection of abutting ridge strip ends and for enhancing the structural integrity of abutting connected ridge strips.

8. The air-conditioning condensate drain channel structure of claim 6, comprising:

said at least one strip of material being a pair of strips of material each defining at least one elongate ridge each having a generally triangular cross-sectional configuration; and said pair of elongate strips of material being mounted to a roofing membrane and disposed in spaced relation to define an air-conditioning condensate drain channel therebetween.

9. The air-conditioning condensate drain channel structure of claim 6, comprising:

said at least one strip of material having a central panel defining side edges and defining a pair of elongate ridge members each being located at a respective one of said side edges and defining an air-conditioning condensate drain channel therebetween; and said at least one strip of material being adapted for mounted to a roofing membrane.

10. The air-conditioning condensate drain channel structure of claim 9, comprising:

said elongate ridges having ends defining dowel receptacles; and dowel elements being received with dowel receptacles of abutting elongate ridges and aligning said ends of abutting ridges, and facilitating connection of said ends of abutting ridges and enhancing the structural integrity of a joint defined by said ends of abutting ridges.

11. The air-conditioning condensate drain channel structure of claim 10, comprising:

a second strip of material having end to end connection with said at least one strip of material and having an extended central panel section being disposed for overlapping relation with a portion of said central panel of said at least one strip of material and preventing water leakage from said drain channel at said joint.

12. An air-conditioning condensate drain channel strip comprising:

a drain channel ridge element having upwardly converging angulated side walls and an upper wall defining an internal ridge space;

at least one base flange being integrally connected with at least one of said angulated side walls and adapting said drain channel strip for mounting to a roofing substrate; and an intermediate internal wall having side edges integrally connected with said angulated side walls and enhancing the structural integrity of said drain channel ridge element.

13. The air-conditioning condensate drain channel strip of claim 12, comprising:

said upper wall being elongate and being of curved configuration and having a convex surface facing upwardly; and said intermediate internal wall being of curved configuration and having a convex surface facing upwardly.

14. The air-conditioning condensate drain channel strip of claim 12, comprising:

each of said upwardly converging angulated side walls having bottom edges; and said at least one base flange being a pair of generally flat flange elements each projecting laterally and outwardly from respective bottom edges of said upwardly converging angulated side walls.

* * * * *